US007091427B2

(12) United States Patent
Luque et al.

(10) Patent No.: US 7,091,427 B2
(45) Date of Patent: Aug. 15, 2006

(54) APPARATUS USING RESONANCE OF A CAVITY TO DETERMINE MASS OF A LOAD

(75) Inventors: Phillip R. Luque, Boise, ID (US); Robert E. Haines, Boise, ID (US); Ben B. Tyson, Eagle, ID (US); John W. Huffman, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 199 days.

(21) Appl. No.: 10/353,909

(22) Filed: Jan. 28, 2003

(65) Prior Publication Data

US 2004/0145107 A1 Jul. 29, 2004

(51) Int. Cl.
*G01L 1/00* (2006.01)
*G01G 9/00* (2006.01)

(52) U.S. Cl. ..... 177/210 FP; 73/580; 271/3.15

(58) Field of Classification Search ..... 177/210 FP; 73/580, 159; 271/9.05, 3.15
See application file for complete search history.

(56) References Cited

U.S. PATENT DOCUMENTS

| | | | | | |
|---|---|---|---|---|---|
| 4,042,879 | A | | 8/1977 | Ho et al. | 324/636 |
| 4,297,874 | A | * | 11/1981 | Sasaki | 73/73 |
| 4,391,338 | A | * | 7/1983 | Patashnick et al. | 177/210 FP |
| 4,405,024 | A | * | 9/1983 | Fraval et al. | 177/200 |
| 4,461,363 | A | * | 7/1984 | Loy | 177/1 |
| 4,561,286 | A | * | 12/1985 | Sekler et al. | 73/24.06 |
| 4,572,006 | A | * | 2/1986 | Wolfendale | 73/862.626 |
| 4,612,807 | A | * | 9/1986 | Wunderer | 73/580 |
| 4,649,759 | A | * | 3/1987 | Lee | 73/862.626 |
| 4,838,369 | A | * | 6/1989 | Albert | 177/210 FP |
| 4,856,603 | A | * | 8/1989 | Murakoso et al. | 177/210 C |
| 5,029,469 | A | * | 7/1991 | Chase et al. | 73/159 |
| 5,127,643 | A | | 7/1992 | DeSanctis et al. | 271/9.05 |
| 5,138,178 | A | | 8/1992 | Wong et al. | 250/559.28 |
| 5,297,062 | A | * | 3/1994 | Cresson et al. | 702/170 |
| 5,349,844 | A | * | 9/1994 | Lilienfeld | 73/28.01 |
| 5,604,335 | A | * | 2/1997 | Isahaya | 177/210 FP |
| 5,691,474 | A | * | 11/1997 | Gerz | 73/580 |
| 5,806,992 | A | | 9/1998 | Ju | 400/56 |
| 5,939,646 | A | | 8/1999 | Fowler | 73/862.193 |
| 5,962,861 | A | | 10/1999 | Fowler | 250/559.27 |
| 6,028,318 | A | | 2/2000 | Cornelius | 250/559.27 |
| 6,080,939 | A | * | 6/2000 | Hassel | 177/210 FP |
| 6,157,791 | A | | 12/2000 | Haines et al. | 399/23 |
| 6,485,205 | B1 | | 11/2002 | Luque | 400/56 |

FOREIGN PATENT DOCUMENTS

| | | |
|---|---|---|
| GB | 2212273 | 7/1989 |
| JP | 55042053 | 3/1980 |

* cited by examiner

*Primary Examiner*—Randy W. Gibson

(57) ABSTRACT

A scale is provided, the scale including a cavity having a resonant frequency which is alterable with variations in mass of a load applied to the cavity. The scale also typically includes a comparator operatively coupled with the cavity to detect actual resonant frequency under the load, to compare such actual resonant frequency with a reference resonant frequency, and to produce a difference signal indicative of mass of the load.

46 Claims, 2 Drawing Sheets

Fig. 4
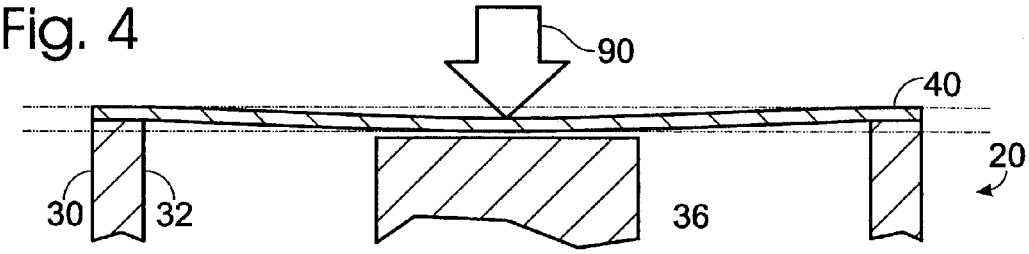
Fig. 5
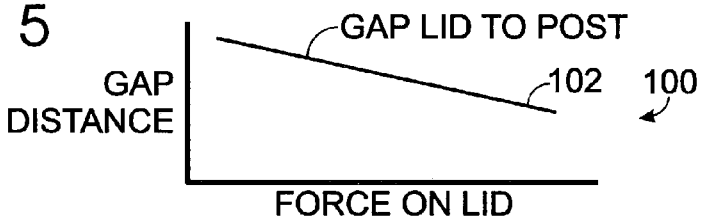
Fig. 6
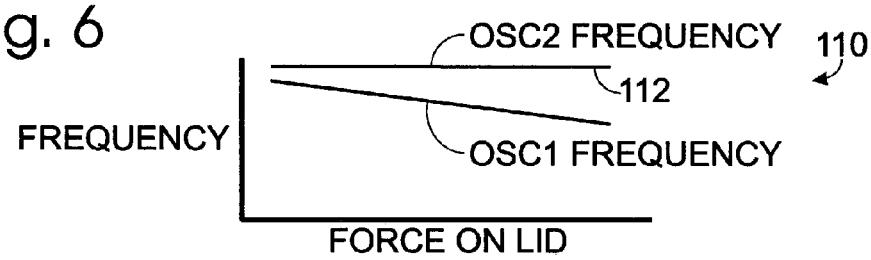
Fig. 7
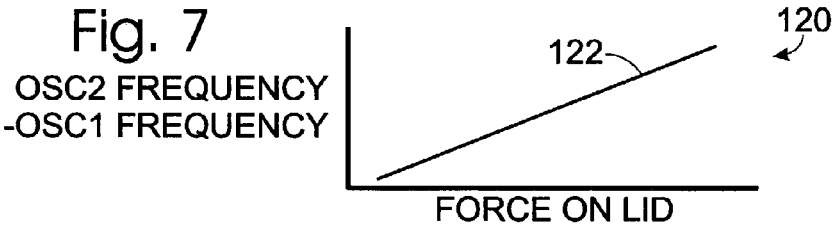
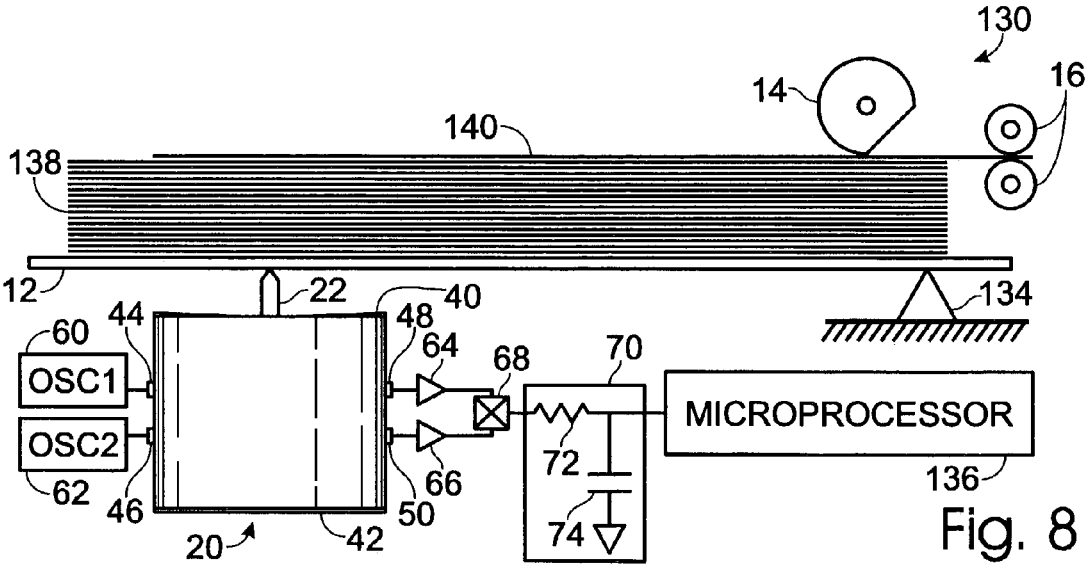
Fig. 8

APPARATUS USING RESONANCE OF A CAVITY TO DETERMINE MASS OF A LOAD

BACKGROUND

Media processing devices, such as laser printers and media sorters, among others, may operate on various types of media, such as various papers or plastics. Printable papers might include wood- and cotton-based materials of different qualities, of virgin and/or recycled content, formed in different thicknesses and with different surface treatments. Printable plastics may include similar variations, in both transparent and opaque forms.

The quality of text and images printed on such media may be dependent on a number of factors. In laser printers, one factor that may affect media processing is "media weight." In this context, "media weight" of a sheet may be defined as mass per unit area where such mass generally is relatively small.

In order to account for varying media weight in media processing devices, it may be desirable to modify operation of such devices to account for media weight, such as modifying the speed at which the media proceeds through a fuser in a laser printer. One approach to determining media weight is to sense media thickness and to determine media weight based on that thickness. However, such an approach may not account for density of the media. Additionally, such thickness sensors may be fragile, expensive and subject to wear, as they may be in contact with the media as it is fed by, to, or within a media processing device. Another approach is to more directly determine media mass. It is in this context that we describe the present scale.

SUMMARY

A scale is provided, the scale including a cavity having a resonant frequency which is alterable with variations in mass of a load applied to the cavity. The scale also typically includes a comparator operatively coupled with the cavity to detect actual resonant frequency under the load, to compare such actual resonant frequency with a reference resonant frequency, and to produce a difference signal indicative of mass of the load.

BRIEF DESCRIPTION OF THE DRAWINGS

FIG. 4 is an enlarged, fragmentary view of the scale of FIG. 2, showing exaggerated deformation of a lid due to a load, such as a media stack within a media tray.

FIG. 5 is a graph showing the relationship between the force exerted on the lid of the scale of FIG. 2 and the gap distance between the lid and a post of a cavity of the scale.

FIG. 6 is a graph showing oscillation frequencies of each oscillator of FIG. 3 as a function of the force exerted on the lid of a cavity of the scale.

FIG. 7 is a graph showing the difference between the oscillation frequencies of each oscillator of FIG. 3 as a function of a force exerted on the lid of a cavity of the scale.

FIG. 8 is a detailed view of a media mass determination system, which may be used in a media processing device to determine media weight according to an embodiment of the invention, such as shown generally in the printer of FIG. 1.

DETAILED DESCRIPTION

Figure 1:
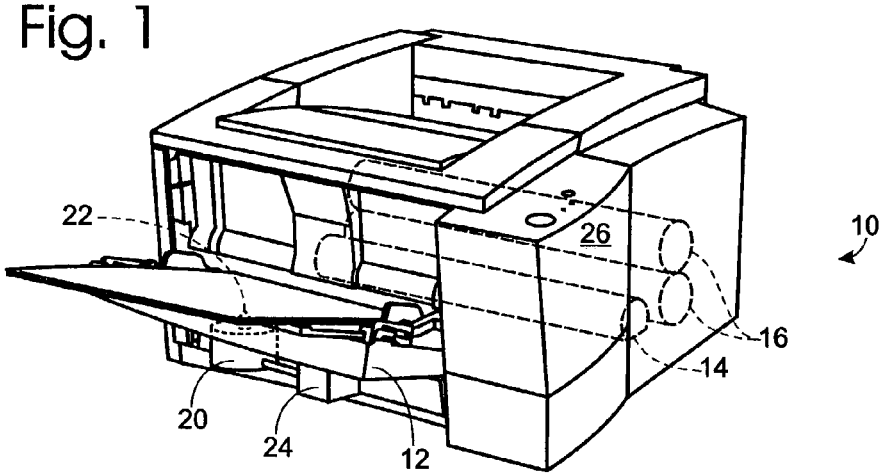
FIG. 1 is an isometric view of a media processing device, specifically a printer, employing a media mass determination system according to an embodiment of the invention.

FIG. 1 is an isometric view of a printer 10 according to an embodiment of the invention. As indicated, printer 10 may include a media tray 12, a feed roller 14 and a toner fuser 16. Printer 10 may also include a scale 20, mechanical coupling 22 and associated media-mass-determination circuitry 24 that may be used to determine various media information. While each of these elements will be described in detail below, briefly, scale 20, mechanical coupling 22 and circuitry 24 may work in conjunction to determine the mass of a load such as media present in media tray 12. Accordingly, those elements collectively may be employed in determining the media weight of fed media and/or the number of media sheets remaining in media tray 12.

In this regard, scale 20 may be coupled with media tray 12 via mechanical coupling 22. The force exerted on scale 20, due to the mass of media held by media tray 12 (and the media tray itself), may be determined by using scale 20 and circuitry 24. For printer 10, scale 20 may operate using radio-frequency signals when making such determinations, though other approaches are possible, and the disclosure is not limited to any particular technique. Based on such force determinations, various information regarding media contained in media tray 12 may be determined, as was indicated above.

Figure 2:
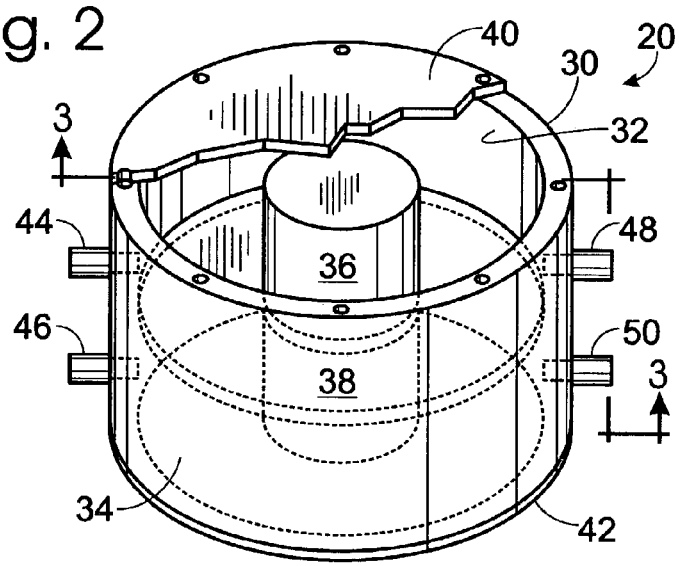
FIG. 2 is an isometric view of a scale that may be used to determine media mass according to an embodiment of the invention.

FIG. 2 shows a more detailed isometric view of scale 20 according to an embodiment of the invention. As may be seen in FIG. 2, scale 20 may include a body 30 having two substantially identical cavities formed therein, which may be termed a scale cavity 32 and a reference cavity 34. Each cavity may include respective center posts 36 and 38, with associated lids, respectively, 40 and 42. It will be appreciated that other cavity configurations are also possible.

For purposes of illustration, lid 40 is depicted in a cut-away fashion. It will be appreciated that lid 40 would typically cover cavity 32. Gaps may be present between center posts 36 and 38 and lids 40 and 42, respectively. Body 30, and lids 40 and 42 may be formed of a metallic material capable of communicating radio-frequency signals. Alternatively, body 30, and lids 40 and 42 may be formed of a non-metallic material and covered, or coated with a metallic material capable of communicating radio-frequency signals, such as a metal foil. Scale 20 may further include connectors 44, 46, 48 and 50, which may include probes and/or antenna configured to couple media-weight-determination circuitry 24 with scale 20. Such circuitry is discussed in more detail hereafter.

The present configuration for scale 20 may provide advantages in determining mass of media within printer 10. For example, reference cavity 34 may function as a calibration (or reference) mechanism for scale cavity 32. In this respect, it will be appreciated that lid 40 of scale cavity 32 may be deflected under a load (e.g., the media tray), but that lid 42 of reference cavity 34 may not be deflected under such a load. This differential deflection may result in detectable differential signal variations, typically evident in differential resonant frequencies of the reference cavity and the scale cavity. In contrast, any variations in resonant frequencies due to environmental factors, such as temperature, humidity, radio-frequency interference, etc., would typically affect cavities 32 and 34 in a similar fashion. Therefore, any signal variations due to such factors may be canceled out by using a comparison circuit to compare resonant frequencies associated with each cavity, as will be discussed below.

Figure 3:
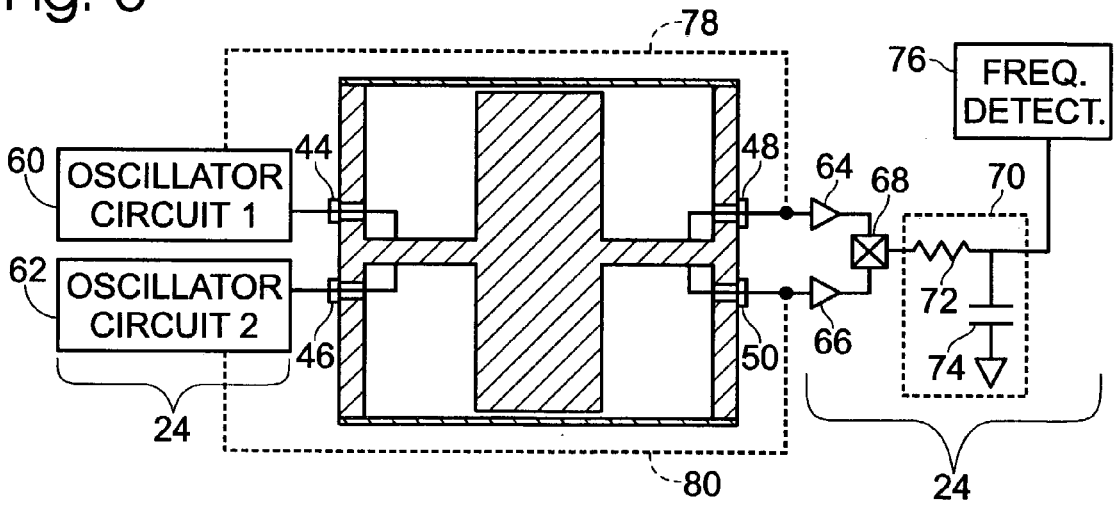
FIG. 3 is a sectional view of the scale of FIG. 2 along section line 3—3, as it may be coupled with associated circuitry, shown in block diagram and schematic form, according to an embodiment of the invention.

FIG. 3 depicts a sectional view of scale 20 along section line 3—3 in FIG. 2, along with media-weight-determination circuitry 24. Media-weight-determination circuitry 24 may include oscillator circuits 60 and 62 (designated oscillator circuit 1 and oscillator circuit 2, respectively), which may be coupled with scale 20 via respective connectors 44 and 46. Oscillators 60 and 62 may be of substantially identical design and configured to oscillate at frequencies (in the radio-frequency range for this embodiment) that may be affected by physical characteristics of, respectively, cavities 32 and 34, and lids 40 and 42.

In particular, oscillators 60 and 62 may be configured to oscillate at frequencies related to the resonant frequencies of cavities 32 and 34, respectively. Such resonant frequencies may, in turn, be affected by changes in physical characteristics of one or both of the cavities, including deflection of the cavity lids. In this regard, it is typical that cavities 32 and 34 and lids 40 and 42 have substantially identical physical characteristics when not under a load. However, since lids 40 and 42 are affected differentially under a load (based on mechanical coupling of such a load to lid 40, but not lid 42), physical characteristics (such as size and shape) of cavities 32 and 34 may differ in the presence of a load. Correspondingly, resonant frequencies of the cavities may differ, as will be discussed further below.

Media-weight-determination circuitry 24 may also include amplifiers 64 and 66, which may be coupled, respectively to oscillators 60 and 62 via cavities 32 and 34, and connectors 48 and 50. Alternatively, amplifiers 64 and 66 may be coupled, respectively, directly to oscillators 60 and 62 via alternative connections 78 and 80. It will be appreciated that such connections typically would be to output terminals (not shown) of oscillators 60 and 62, or to the connections between oscillators 60 and 62 and cavities 32 and 34, respectively. Amplifiers 64 and 66 may be further coupled with a frequency comparator 68 (also referred to herein as a mixer).

Those skilled in the art will understand that variations in cavity construction are possible. For example, portions of the cavity wall may be formed from sections of printed circuit boards which have traces that act as probes or antennas, possibly eliminating the need for some of the connectors 44, 48, 46 or 50. It also will be appreciated that the oscillator circuits 60 and 62, and the amplifier circuits 64 and 66, may be located within the cavities, and that the cavities need not be constructed in the cylindrical configuration shown.

Frequency comparator 68 may receive signals generated in cavities 32 and 34 by oscillators 60 and 62, and amplified by amplifiers 64 and 66, and may mix these signals. Mixing may include subtracting one signal frequency from the other signal frequency to produce what may be termed a difference signal. As indicated previously, it will be appreciated that the physical characteristics of cavities 32 and 34 may affect the frequency of such received signals (each of which is typically at a frequency corresponding to the resonant frequency of the associated cavity). Such a difference signal may also account for any variation in the oscillator signals due to environmental factors (also referred to as ambient conditions) due to the two-cavity configuration of scale 20. As previously described, these oscillator signals are typically of substantially identical frequency when scale 20 is not under a load. Any difference in the oscillator signals due to a load (e.g. on lid 40 via mechanical coupling 22) may be used in making determinations of mass of the load, as will be described hereafter.

A difference signal generated by frequency comparator 68 may be communicated to filter 70. As shown in FIG. 3, filter 70 may be a low-pass filter, and may include a resistor 72 and a capacitor 74. Filter 70 may reduce radio-frequency noise that may be present in a difference signal. Filtering this noise may be advantageous as it may allow more accurate media mass determinations to be made. In addition to the difference signal, the output of the frequency comparator 68 may include signals received from oscillators 60 and 62, and a signal having a frequency corresponding to the sum of the frequency of the signals received from oscillators 60 and 62. Since these signals typically are at a much higher frequency than the difference signal, the low-pass filter may effectively suppress these signals while passing the desired difference signal.

FIG. 4 shows a partial sectional view of apparatus 20, which depicts exaggerated deformation of lid 40 when subjected to a load 90, such as would be produced by the presence of a media stack in media tray 12 in printer 10. This deformation of lid 40 may result in a decrease in the gap between lid 40 and center post 36. Such a reduction in that gap may alter the overall physical characteristics of cavity 32, and of lid 40, which, in turn, may affect the resonant frequency of the cavity, and correspondingly, the oscillation frequency of oscillator 60. This, in turn, may be evident in the signal generated by oscillator 60 in cavity 32.

FIG. 5 is a graph 100, which illustrates a relationship between the force exerted on lid 40 by load 90 and the gap between lid 40 and center post 36. As would be expected, as the force exerted by load 90 increases (such as increasing the amount of media in media tray 12), the gap between lid 40 and center post 36 decreases substantially linearly. This may produce a corresponding linear change in resonant frequency of cavity 32, and oscillation frequency of oscillator 60. In this respect, as is shown by graph 110 in FIG. 6, as the force exerted on lid 40 by load 90 increases, the frequency of oscillator 60 (oscillator 1) may decrease while the frequency of oscillator 62 (oscillator 2) may remain substantially constant, given that lid 42 typically is not subjected to such load.

FIG. 7 is a graph 120, which illustrates the linear relationship of the difference between the frequency of oscillators 60 and 62, and the force on lid 40. Frequency comparator 68, which may be a radio-frequency mixer circuit, may determine such a difference. As the force on lid 40 increases (decreasing the gap between lid 40 and post 36, and, in turn, the frequency of oscillator 60), the difference between the two frequencies increases linearly. This difference is indicative of the mass of media loaded in media tray 12, as has been previously indicated, and is discussed in further detail below.

FIG. 8 illustrates a media mass determination system according to an embodiment of the invention, which is indicated generally at 130. System 130 is a more detailed view of a system, such as was discussed above with respect to printer 10 of FIG. 1, and the associated components shown in FIGS. 2–4. Those elements that were previously discussed generally are indicated with the same reference numbers as above. System 130 further includes fulcrum 134 that may be used as a pivot point for media tray 12, which may help to provide for consistent measurements by providing a stable rotation axis for media tray 12.

For system 130, previously-described frequency detector 76 may take the form of a processor such as microprocessor 136. Microprocessor 136 may include an analog-to-digital port, which may be used determine the frequency of difference signals communicated to microprocessor 136 from frequency comparator 68, via filter circuit 70. As has been previously indicated, these difference signals may indicate the mass of media stack 138 in media tray 12. Based on these difference signals, various determinations are possible such as the media weight of a media sheet 140, or the number of sheets of media remaining in media tray 12, as two examples. Furthermore, microprocessor 136 may control operation of printer 10 based on these determinations.

System 130 may determine the weight of a single media sheet 140 in the following manner. A difference signal with no load on either of lids 40 and 42 may be determined. This difference may be termed a calibration offset and factored into any mass determinations. After determining the calibration offset, a difference signal associated with the mass of media tray 12 may be determined. Based on a known mass of media tray 12, a conversion factor may be determined which may be applied to difference signals to convert them to mass measurements. Such a conversion factor may be in terms of grams per kilohertz, or any other appropriate ratio.

Media tray 12 may then be loaded with media stack 138 and media sheet 140, and another difference signal may be obtained. The mass of media stack 138 (with media sheet 140) may then be determined from the loaded difference signal, the unloaded difference signal, the calibration offset and the conversion factor. For example, subtracting the frequency of the loaded difference signal from the frequency of the unloaded difference signal, adjusting that calculation by the calibration offset and multiplying the result by the conversion factor may provide the mass of media stack 138 (with media sheet 140).

Upon determining the mass of media stack 138 with media sheet 140, media sheet 140 may be fed from media tray 12 by feed roller 14. Thereafter, another difference signal may be obtained, and the mass of sheet 140 may be determined based on the change between the pre-feed difference signal (with media sheet 140) and the post-feed difference signal (without media sheet 140). It will be appreciated that this change typically is a change in signal frequency (corresponding to a change on resonance frequency of a cavity) corresponding to a change is mass, as described above. This change in mass corresponds to the mass of media sheet 140. Upon determining the mass of sheet 140, the weight of media sheet 140 may be determined by dividing such mass by the surface area of the media sheet.

It will be appreciated that microprocessor 136 may retain information related to the various difference signals, and may also execute the calculations discussed herein. Furthermore, similar determinations and calculations may be made surrounding subsequent feed operators for use in calculating an average media sheet mass, and thus an average media weight.

Based on the determined mass and/or media weight of media sheet 140, microprocessor 136 may modify an operational parameter of printer 10, such as rate of media feed, electrophotographic marking material transfer parameters, fusing temperature and/or fusing pressure. Such modifications may improve print quality, as the weight of the media may be accounted for in the toner fusing process.

Additionally, assuming media 138 is homogeneous and of the same type as media sheet 140, an estimate of the number of sheets remaining in media tray 12 may be made by system 130. In this respect, the mass of media 138 may be divided by the mass of media sheet 140 to provide such an estimate. Estimating the number of sheets of media 138 remaining in printer 10 may be advantageous in a number of respects, such as when printing secure print jobs. Microprocessor 136 may determine that there is insufficient media 138 remaining in media tray 12 to complete such a secure print job and, as a result, delay printing such a job until sufficient media is present in media tray 12. Alternatively, an indication that a printer is nearly out (or is out) of media may be provided.

A method of measuring mass of a load thus may be understood to include determining resonant frequency of a cavity, wherein the cavity has a resonant frequency related to physical characteristics of the cavity which vary with variations in the load. A reference frequency thereafter may be identified which corresponds to the resonant frequency of the cavity absent the load. This may be determined via a reference cavity, or simply based on knowledge of the resonant frequency of the alterable cavity absent a load. Finally, a difference between the resonant frequency and the reference frequency may be determined to produce a difference signal indicative of mass of the load.

Alternatively, the method may include determining resonant frequency of a first cavity wherein the first cavity has a first resonant frequency related to physical characteristics of the first cavity which are independent of the load, determining resonant frequency of a second cavity wherein the second cavity has a second resonant frequency related to physical characteristics of the second cavity which vary with variations in the load, and determining a difference between the first resonant frequency and the second resonant frequency to produce a difference signal indicative of mass of the load. It will be appreciated that the resonant frequency of the second cavity typically varies substantially linearly with variations in mass of the load. Mass of the load thus may be calculated based on this substantial linearity between variations in the second resonant frequency and variations in mass of the load.

Media weight thus may be determined in a printer via a method wherein a pre-feed difference is determined between resonant frequencies of first and second cavities of a multi-cavity structure, wherein resonant frequencies of the first and second cavities are differentially influenced by mass of a media stack. A media sheet then may be removed from the media stack, and a post-feed difference may be determined between resonant frequencies of the first and second cavities. A change between the pre-feed difference and the post-feed difference thus may be determined, such change being indicative of mass of the media sheet. The mass of the media sheet then may be divided by an area of the media sheet to provide media weight. It also is possible to estimate a number of media sheets remaining in the media stack by dividing the post-feed difference by the change between the pre-feed difference and the post-feed difference., and to calculate a dynamic average media sheet mass for successive media sheets removed from the media stack.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite “a” or “a first”

element or the equivalent thereof, such claims should be understood to include incorporation of one or more such elements, neither requiring nor excluding two or more such elements.

What is claimed is:

1. An apparatus for determining mass of a load, the apparatus comprising:

a first radio-frequency oscillator coupled with a first cavity having a first resonant frequency;

a second radio-frequency oscillator coupled with a second cavity, the second cavity having a second resonant frequency related to a physical characteristic of the second cavity which varies with variations in mass of the load; and a comparator operatively coupled with the first and second cavities to receive first and second signals indicative, respectively, of the first and second resonant frequencies, and to produce a difference signal indicative of mass of the load.

2. The apparatus of claim 1, wherein the first resonant frequency is substantially independent of mass of the load.

3. The apparatus of claim 1, wherein the first resonant frequency and the second resonant frequency vary differentially with variations in mass of the Load.

4. The apparatus of claim 1, wherein the first cavity and second cavity nominally are of substantially similar configuration.

5. The apparatus of claim 3, wherein the load is mechanically coupled with the second cavity so as to effect variations in the physical characteristic proportional to variations in mass of the load.

6. The apparatus of claim 5, wherein the physical characteristic is size.

7. The apparatus of claim 5, wherein the physical characteristic is shape.

8. The apparatus of claim 1, wherein the load is mechanically coupled with a wall of the second cavity so as to deform the wall of the second cavity in proportion to variations in mass of the load.

9. The apparatus of claim 8, wherein the first cavity is not substantially deformed with variations in mass of the load.

10. The apparatus of claim 9, wherein the second resonant frequency varies substantially linearly with deformation of the wall of the second cavity.

11. The apparatus of claim 10, wherein the first cavity and the second cavity are disposed within a common body.

12. The apparatus of claim 11, wherein the first cavity and the second cavity are configured so as to accommodate radio-frequency communication of the first and second signals, respectively, between the first and second oscillators and the comparator.

13. The apparatus of claim 1, wherein the load is a stack of media sheets configured to be fed sheet-by-sheet.

14. The apparatus of claim 13, wherein the comparator is configured to produce a pre-feed difference signal and a post-feed difference signal.

15. The apparatus of claim 14, which further comprises a processor coupled with the comparator, the processor being configured to determine a change between the pre-feed difference frequency and the post-feed difference signal, such change being indicative of mass of a fed media sheet.

16. The apparatus of claim 15, wherein the post-feed difference signal is indicative of mass of a post-feed mass of the stack of media sheets, a quotient of the post-feed mass of the stack of media sheets divided by the mass of the fed media sheet being indicative of a number of sheets remaining in the stack of media sheets.

17. The apparatus of claim 15, wherein the processor is further configured to associate the indicated mass of the fed media sheet with an area of the fed media sheet, a quotient of such mass of the fed media sheet divided by the area of the fed media sheet being indicative of a media weight of the fed media sheet.

18. The apparatus of claim 17, wherein the processor is further configured to modify an operational parameter of an associated electronic device based on the media weight of the fed media sheet.

19. The apparatus of claim 18, wherein the associated electronic device is a printing device, and the operational parameter is at least one of media feed rate, electrophotographic marking material transfer parameters, fusing temperature and/or fusing pressure.

20. A method of measuring mass of a load, the method comprising:

determining a resonant frequency of a cavity with respect to radio-frequency signals, the cavity having a resonant frequency related to physical characteristics of the cavity which vary with variations in the load;

identifying a reference frequency corresponding to a resonant frequency of the cavity absent the load;

determining a difference between the resonant frequency and the reference frequency to produce a difference signal indicative of mass of the load.

21. A method of measuring mass of a load, the method comprising:

determining a resonant frequency of a first cavity with respect to radio-frequency signals, the first cavity having a first resonant frequency related to physical characteristics of the first cavity which are independent of the load;

determining a resonant frequency of a second cavity with respect to radio-frequency signals, the second cavity having a second resonant frequency related to physical characteristics of the second cavity which vary with variations in the load;

determining a difference between the first resonant frequency and the second resonant frequency to produce a difference signal indicative of mass of the load.

22. The method of claim 21, wherein the resonant frequency of the second cavity varies substantially linearly with variations in mass of the load.

23. The method of claim 22, which further comprises calculating mass of the load based on substantial linearity between variations in the second resonant frequency and variations in mass of the load.

24. An apparatus for determining mass of a load, the apparatus comprising:

means for generating first radio-frequency signal across a first cavity, the first signal having a frequency corresponding to a resonant frequency of the first cavity, such resonant frequency being independent of variations in mass of the load;

means for generating second radio-frequency signal across a second cavity, the second signal having a frequency corresponding to a resonant frequency of the second cavity, such resonant frequency of the second cavity varying with variations in mass of the load; and means for receiving the first and second signals and of producing a corresponding difference signal indicative of mass of the load.

25. The method of claim 20, wherein the physical characteristic is size.

26. The method of claim 20, wherein the physical characteristic is shape.

27. The method of claim 20, wherein the load is a media stack in a printer, the method further comprising:

removing a media sheet from the media stack;

determining a post-feed difference between the resonant frequency of the cavity and the reference frequency;

determining a change between a pre-feed difference between the resonant frequency of the cavity and the reference frequency and the post-feed difference between the resonant frequency of the cavity and the reference frequency, such change being indicative of mass of the media sheet; and dividing the mass of the media sheet by an area of the media sheet to provide media weight.

28. The method of claim 27, which further comprises controlling media processing based on the media weight.

29. The method of claim 28, wherein controlling media processing includes modifying at least one of media feed rate, electrophotographic marking material transfer parameters, fusing temperature and fusing pressure.

30. The method of claim 27, which further comprises estimating a number of media sheets remaining in the media stack by dividing the post-feed difference by the change between the pre-feed difference and the past-feed difference.

31. The method of claim 27, which further comprises calculating a dynamic average media sheet mass for successive media sheets removed from the media stack.

32. The apparatus of claim 1, wherein the first cavity and the second cavity are each configured to communicate radio-frequency signals.

33. The apparatus of claim 32, wherein the first oscillator is configured to generate the first signal with a frequency corresponding to the first resonant frequency, and the second oscillator is configured to generate the second signal with a frequency corresponding to the second resonant frequency.

34. The apparatus of claim 33, wherein the comparator is a radio-frequency signal mixer configured to generate the difference signal with a frequency corresponding to the difference between the first and second signals.

35. The apparatus of claim 1, wherein the load is a media stack in a printer, wherein the first cavity has a first center post formed therein, wherein the second cavity has a second center post formed therein, wherein the second cavity and the second center post are substantially similar to the first cavity and the first center post, and wherein the apparatus further comprises:

a tray configured to hold the media stack;

a first lid covering the first cavity and nominally defining a first gap between the first lid and the first center post;

a second lid covering the second cavity and nominally defining a second gap between the second lid and the second center post, the second gap being substantially equal to the first gap absent a force being applied to the second lid;

a mechanical coupling which couples the tray with the second lid so as to deform the second lid under a force related to mass of the stack of media sheets within the tray; and a processor configured to receive the difference signal from the comparator and to determine mass of the stack of media in the tray based on the difference signal, wherein the first oscillator is coupled with the first cavity to produce the first signal, the second oscillator is coupled with the second cavity to produce the second signal as influenced by deformation of the second lid.

36. The apparatus of claim 35, wherein the first lid remains substantially undeformed as the second lid is deformed under the force related to mass of the stack of media sheets within the tray.

37. The apparatus of claim 35, wherein the first signal is substantially independent of the force related to mass of the stack of media sheets within the tray.

38. The apparatus of claim 1, wherein the first and second signals vary in concert with changes in ambient conditions.

39. The apparatus of claim 35, which further comprises a feed mechanism configured to selectively remove a media sheet from the tray.

40. The apparatus of claim 39, wherein the comparator is configured to produce a pre-feed difference signal and a post-feed difference signal.

41. The apparatus of claim 40, wherein the processor is configured to determine a change between the pre-feed difference signal and the post-feed difference signal, such change being indicative of mass of the removed media sheet.

42. The apparatus of claim 41, wherein the post-feed difference signal is indicative of mass of a post-feed mass of the stack of media sheets, a quotient of the post-feed mass of the stack of media sheets divided by the mass of the removed media sheet being indicative of a number of sheets remaining in the stack of media sheets.

43. The apparatus of claim 41, wherein the processor is further configured to associate the indicated mass of the removed media sheet with an area of the removed media sheet, a quotient of such mass of the removed media sheet divided by the area of the removed media sheet being indicative of a media weight of the removed media sheet.

44. The apparatus of claim 43, wherein the processor is further configured to modify an operational parameter of the printer based on the media weight of the removed media sheet.

45. The apparatus of claim 44, wherein the operational parameter is at least one of media feed rate, electrophotographic marking material transfer parameters, fusing temperature and fusing pressure.

46. An apparatus for determining mass of a load, the apparatus comprising:

a first cavity having a resonant frequency independent of the mass of the load, wherein the first cavity is operatively coupled to a first radio-frequency oscillator;

a second cavity having a resonant frequency functionally related to physical characteristics of the second cavity that vary with variations in the load, wherein the second cavity is operatively coupled to a second radio-frequency oscillator; and a comparator operatively coupled with the first and second cavities to receive first and second signals indicative of the resonant frequencies of the first and second cavities, respectively, and to produce a difference signal indicative of mass of the load.

* * * * *

UNITED STATES PATENT AND TRADEMARK OFFICE

CERTIFICATE OF CORRECTION

PATENT NO. : 7,091,427 B2
APPLICATION NO. : 10/353909
DATED : August 15, 2006
INVENTOR(S) : Phillip R. Luque et al.

It is certified that error appears in the above-identified patent and that said Letters Patent is hereby corrected as shown below:

In column 7, line 24, in Claim 3, delete “Load” and insert -- load --, therefor.

In column 9, line 23, in Claim 30, delete “past-feed” and insert -- post-feed --, therefor.

Signed and Sealed this

Twenty-fourth Day of February, 2009

John Doll

JOHN DOLL
*Acting Director of the United States Patent and Trademark Office*